US006015327A

United States Patent [19]

Kovacs

[11] Patent Number: 6,015,327

[45] Date of Patent: Jan. 18, 2000

[54] WIND POWERED BUBBLE MAKING DEVICE

[76] Inventor: Ernest David Kovacs, 219 Mortani Point, East Palatka, Fla. 32131

[21] Appl. No.: 09/163,059

[22] Filed: Sep. 29, 1998

[51] Int. Cl.[7] ..... A63H 33/28

[52] U.S. Cl. ..... 446/15; 446/15; 446/71

[58] Field of Search ..... 446/15, 16, 71; 40/408

[56] References Cited

U.S. PATENT DOCUMENTS

| | | | |
|---|---|---|---|
| D. 185,805 | 8/1959 | Clark | 446/16 |
| 2,225,702 | 12/1940 | Lyon, Jr. | 446/15 |
| 2,454,794 | 11/1948 | Saachy | 446/16 |
| 2,862,320 | 12/1958 | Mayo | 446/16 |
| 3,100,947 | 8/1963 | Hellman | 446/16 |
| 4,062,143 | 12/1977 | Lerman | 446/16 |
| 5,462,469 | 10/1995 | Lei | 446/15 |
| 5,498,191 | 3/1996 | DeMars | 446/15 |
| 5,520,564 | 5/1996 | DeMars | 446/15 |

*Primary Examiner*—Robert A. Hafer
*Assistant Examiner*—Jeffrey D. Carlson
*Attorney, Agent, or Firm*—Thomas C. Saitta

[57] ABSTRACT

A bubble making device which is powered solely by the wind or forced air, the device having a fan which is rotated by the wind which in turns operates a pumping assembly to deliver bubble forming fluid to a plural number of rotating wands, the wands also being rotated by the rotation of the fan. The bubble forming fluid is applied directly to the wands by a brush or wiper applicator, and any excess fluid is recaptured and returned into the main receptacle. The device is light-weight and virtually spill-proof.

14 Claims, 3 Drawing Sheets

WIND POWERED BUBBLE MAKING DEVICE

BACKGROUND OF THE INVENTION

The invention relates generally to the field of bubble making devices, and more particularly to the field of wind-powered bubble making devices.

Various devices which create bubbles are well known, some as simple as a hand-held looped wand which is dipped into a bubble-making solution to achieve a thin film stretched across the loop, through which air is then blown from the mouth of the user. Because of the popularity of such entertainment devices, the state of the art of bubble makers has advanced. First, bubble makers having multiple loops were developed to increase the number of bubbles produced from a single blow or by pulling the larger wand rapidly through the air. The next progressive step in the art was the development of automatic or powered bubble makers, such as seen in U.S. Pat. Nos. 5,498,191 to DeMars, 5,613,890 to DeMars, 5,462,469 to Lei, 5,078,636 to Clarke et al., 5,269,715 to Silveria et al., which do not require the user to blow through the wands to create the bubbles. One particular style of these more advanced bubble making devices operate similarly to a propeller or windmill, wherein a plural number of looped wands extend from a hub connected in some manner to a wind-powered, rotating fan or propeller, the wands being sequentially passed through a reservoir containing the bubble-making solution by rotation of the propeller or fan, which in turn exposes the loops to a current of air. Examples of such devices are seen in U.S. Pat. Nos. 2,862,320 to Mayo, 3,008,263 to Ellman, and 5,542,869 to Petty. These devices can be placed in a wind stream to automatically and continually produce a multitude of bubbles as long as the wind moves the fan and the bubble-making solution remains in sufficient amount in the reservoir to properly coat the wand loops. A problem with these devices is that the reservoirs are open topped containers which are filled with bubble-making solution from a second container, and once filled the reservoirs are susceptible to spillage if the device is moved or bumped.

It is an object of this invention to provide an automatic, wind-powered, bubble making device which does not utilize an open-topped, solution-filled reservoir to coat the rotating wands, such that very little or no spillage occurs if the device is bumped or tipped. These and other objects which will be clear from the description below are accomplished by providing a pumping mechanism operated by the fan which draws bubble-making solution from a closed reservoir and supplies it directly to the loops of the rotating wands, with any excess solution falling into a catch basin where it is recycled into the closed reservoir.

SUMMARY OF THE INVENTION

The invention is an automatic, wind-powered, bubble making device comprising in general a fluid reservoir assembly for retaining bubble-making solution in a generally closed manner, a fan assembly which is rotated by the wind or other moving air stream, such as may be produced by pushing the device through the air, and means to transfer the rotational movement of the fan assembly to a secondary axle to power pumping means and to rotate a wand assembly, the pumping means delivering the bubble-making solution from the reservoir assembly to applicator means which apply the solution to the apertured ends of the rotating wand assembly, with the wand assembly rotating to expose the film applied on the wands to the air stream to produce bubbles and to return the empty wands to the applicator means. The device further comprises a fluid recycling assembly which captures any excess bubble-making fluid falling from the wands and returns the fluid to the main reservoir. Check valves are preferably provided such that the solution will be retained within the fluid reservoir in the event the device is tipped of bumped. Mounting means may be provided for attaching the device to fixed objects, kites, bicycles, boats, cars or other vehicles.

DETAILED DESCRIPTION OF THE INVENTION

In general, the invention is a wind-powered, bubble making device, where the bubblemaking fluid is transferred from a generally enclosed storage reservoir to an applicator means by the rotation of a fan and where also the bubble-making wands are sequentially rotated past the applicator means by the rotation of the fan. With reference to the drawings, the invention will now be described in detail with regard for the best mode and the preferred embodiment.

Figure 1:
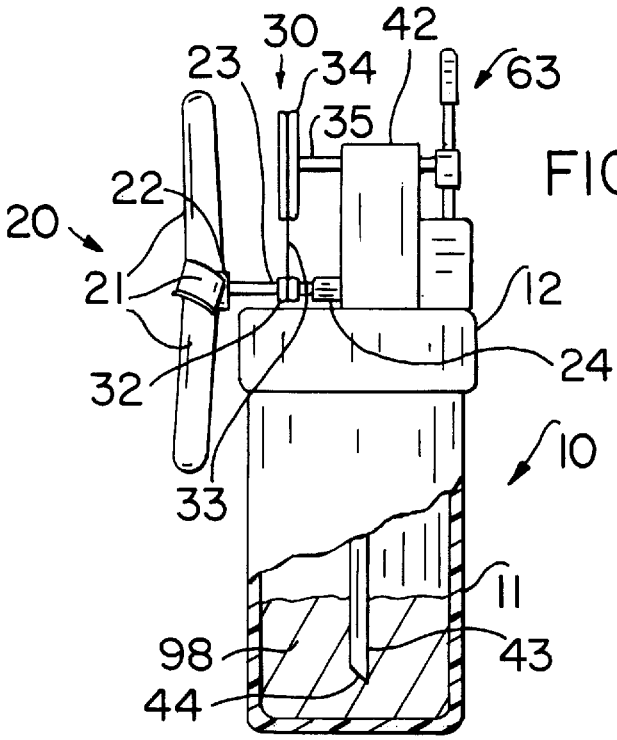
FIG. 1 is a side view of the invention, shown partially exposed.
Figure 2:
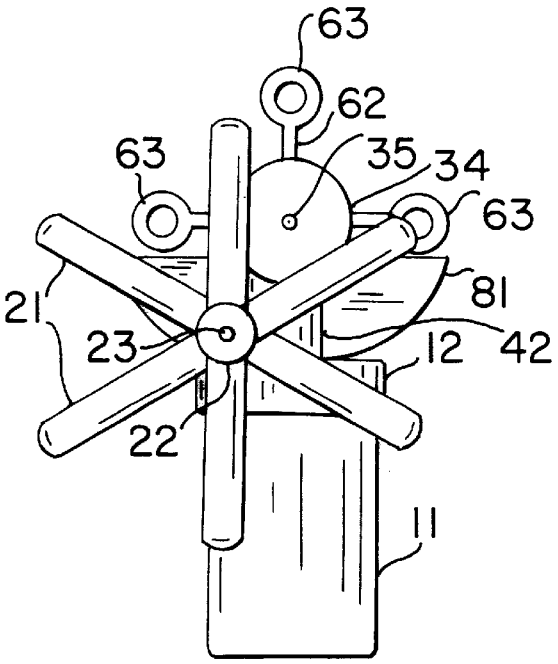
FIG. 2 is a front view of the invention.
Figure 3:
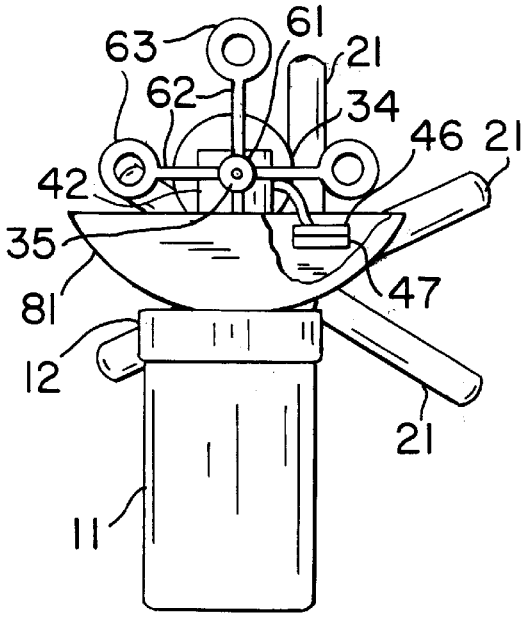
FIG. 3 is a rear view of the invention.

As shown in FIGS. 1 through 3, the invention broadly comprises a fluid reservoir assembly 10, a fan assembly 20, means 30 to transfer rotation from the fan to a bubble-forming wand assembly 60, wind-powered pumping means 40 to transfer bubble-making fluid 98 from the reservoir 10 for application onto the wands 62 of a bubble-forming wand assembly 60, and a fluid recycling assembly 80 for capturing excess fluid 98 and returning it to the fluid reservoir assembly 10.

The fluid reservoir assembly 10 comprises a generally closed container or receptacle body 11 having sides and a bottom for retaining the liquid bubble-making solution or fluid 98 therein. The receptacle body 11 is constructed to correspondingly mate with a cap or base member 12, which as shown encompasses the means to secure the receptacle body 11 to the operational components of the device, the cap member 12 acting as a base to which various other components are attached. In the preferred embodiment, the cap 12 and receptacle 11 are threaded so that they can be repeatedly joined and detached, thereby allowing the receptacle 11 to be refilled with fluid 98 when the supply has been depleted. The cap member 12 may be sized so as to fit onto the standard bottles in which bubble-forming fluid 98 is sold, thus allowing the user to use the new bottle as the receptacle 11 as opposed to having to pour the fluid 98 into the original receptacle 11. The particular dimensions of the receptacle may vary, provided the rotation of the fin blades 21 is not obstructed and provided that the suction tube 43 which is the conduit to remove the fluid 98 from the receptacle 11 is properly sized to reach to the bottom of the receptacle 11. An adaptor sleeve, properly sized and threaded to mate with the threats of the cap 12 and the threads of a large, broad-shouldered, bubble-making solution bottle, may be provided to raise the blades 21 above the shoulder of the large bottle. Alternatively, the receptacle 11 may be permanently joined to the cap or base member 12 and a removable plug or seal provided to refill the receptacle 11.

The fan assembly 20 comprises a plural number of blades 21 mounted onto a hub 22, which is joined to a rotating fan axle 23. The fan axle 23 is connected to the other operating components of the device by a fixed fan mounting means 24, which as shown is mounted onto the cap member 12. The fan assembly 10 is preferably formed of light-weight materials, such as plastic, such that the blades 21 are easily rotated whenever the wind is blowing or whenever the device is physicaly moved in the forward axial direction. The blades 21 may be shaped in any manner suitable for this purpose. Rotation of the blades 21 by wind power results in rotation of the fan axle 23, and this rotational force is used to power both the fluid pumping means 40 and the rotating wand assembly 60 to produce bubbles. Because the revolutions per minute (rpm) of the fan blades 21 will be much higher than is required or desired for pumping the fluid 98 and rotating the bubble wands 62, means 30 to transfer rotation from the fan axle 23 of the fan assembly 20 to a secondary axle 35 to power the pumping means 40 and to rotate the wand assembly 30 must also reduce the rpm of the blades 21. This reduction in rpm also increases torque, which is necessary for driving the pumping means 40.

As shown in the figures, the reduction means 30 to transfer rotation from the fan axle 23 to the secondary axle 35 is accomplished by a pulley reduction assembly 31. The pulley assembly comprises a small pulley 32 mounted onto the fan axle 23 and a large pulley 34 mounted onto the secondary axle 35, with a belt 33, smooth or toothed, extending snugly between the two pulleys 32 and 34, although the belt 33 could directly encircle the fan axle 23 without the small pulley 32. Because of the disparity in circumference between the small pulley 32 and large pulley 34, it takes multiple rotations of the fan axle 23 to result in a single rotation of the secondary axle 35. Although the actual ratio will be dependent on the force necessary to drive the particular pumping means 40 and on the size and number of wands 62, as well as other factors, a reduction ratio of 16:1 has been found to be suitable for this purpose in the embodiment as shown. Alternatively, the transfer reduction means 30 could comprise a gear box assembly with enmeshed reduction gears, or any other rotational reduction assembly known in the art.

The secondary axle 35 is mounted onto and through the pump housing 42. The wand assembly 60 is mounted onto the end of the secondary axle 35, and comprises a plural number of wands 62 joined to a hub 61 connected directly to the secondary axle 35. The wands 62 extend radially from the hub 61 and axle 35, and each wand 62 comprises an apertured end or loop 63, preferably circular with a surface optimally formed as known in the bubble making art, across which a film of bubble-forming fluid 98 is deposited such that air passing through the apertured end 63 will cause a bubble to form and detach from the wand 62. The apertured end 63 of each wand 62 is preferably positioned such that the plane containing the loops 63 is perpendicular to the axis of the secondary axle 35. The wand assembly 60 is preferably formed of light-weight materials, such as plastic, such that a relatively small amount of force is required to rotate the wands 62.

The secondary axle 35 also operates the pumping means 40 to deliver fluid 98 from the reservoir assembly 10 to the wand assembly 60. The pumping means 40 may be any suitable type which can be powered by the rotational energy of the rotating fan blades 21 without need for additional or alternative power means. As shown in detail in FIG. 4, a preferred embodiment of pumping means 40 comprises a suction tube or conduit 43 having an open end 44 and which extends from a tubular pump casing 52 fully into the interior of the fluid receptacle 11. Positioned within the casing 52 is a hollow piston member 53 which is axially movable relative to the casing 52. A spring member 54 biases the piston 53 in the extended position unless sufficient force is applied to compress the spring 54. When the piston 53 advances outwardly after being depressed, a suction is created within casing 52 which draws fluid 98 from the reservoir receptacle 11 and into the lower interior of the casing 52. A first one-way check valve 55, shown as a ball-type check valve, is positioned at the juncture of the casing 52 and the suction tube 43, such that fluid can be drawn into the casing 52 from the suction tube 43, but will not flow from the casing 52 back into the suction tube 43 and reservoir 11.

The piston 53 is open on its interior end and constructed to define a second one-way check valve 56, shown as a ball-type check valve, whereby fluid 98 may flow into the piston 53 through the interior end when the piston 53 is pushed into the casing 52, but where fluid 98 cannot flow out of the piston 53 through the interior end when the piston is extended by the action of spring member 54. A fluid delivery conduit 45 is communicatingly connected to the exposed exterior end of the piston 53. When the piston 53 is depressed, fluid 98 present in the lower section of the casing 52 is forced into the interior of piston 53 and the fluid 98 present in the piston 53 is forced into the delivery conduit 45. When the depressive force is removed, the spring member 54 extends the piston 53 from the casing 52, which again draws fluid 98 into the lower portion of the casing 52. Such pumps are well known in the art. Alternatively, a vane-type pump or other construction may be substituted for the pump construction as described, provided that the pumping operation can be accomplished solely through the force generated by the rotating fan blades 21.

Figure 4:
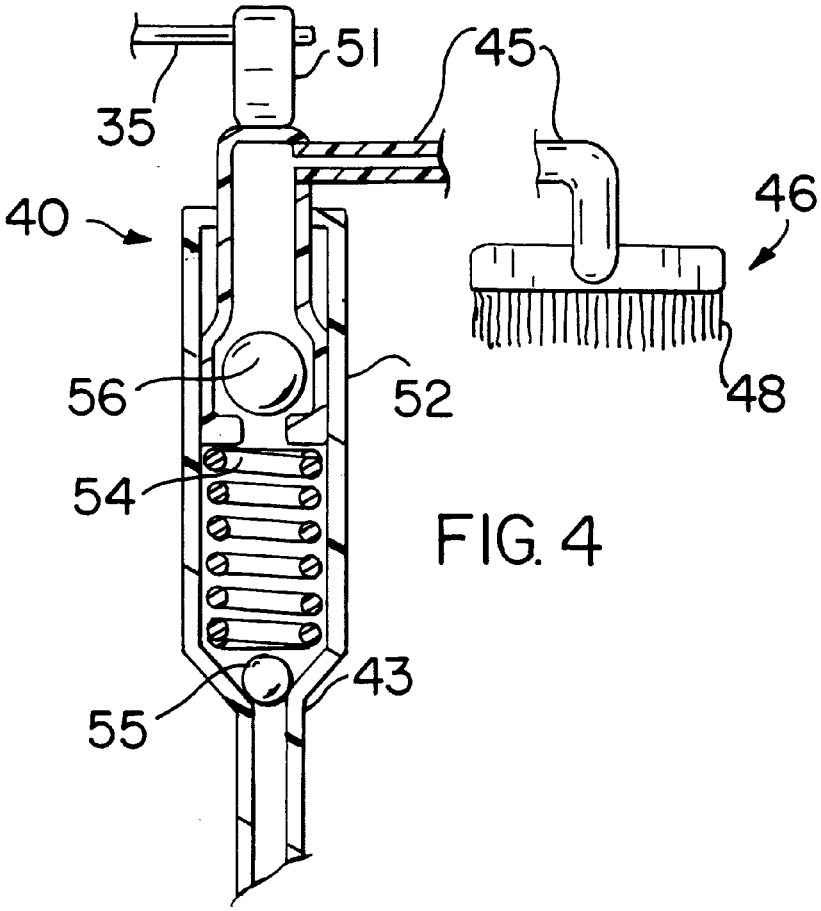
FIG. 4 is a partially exposed, cross-sectional view of the pumping means for transfer of the bubble making fluid from the reservoir to the applicator means.

As shown in the FIG. 4, the piston 53 is moved by a cam member 51 mounted onto secondary axle 35. The off-center positioning of the cam 51 depresses the piston 53 during certain segments of rotation and allows the spring member 54 to extend the piston 53 during the other segments. Alternative operative elements, such as a camshaft or gearing could also be utilized to provide reciprocating movement to the piston 53. In this manner, rotation of the fan blades 21 by wind rotates fan axle 23, which in turn rotates secondary axle 35 to cycle piston 53 to deliver bubble-forming fluid 98 through fluid conduit 45.

The bubble-forming fluid 98 passes through the conduit 45 to the applicator means 46, which applies the fluid 98 to the apertured end 63 of each wand 62 in a manner which produces a thin film across the aperture itself, such that a bubble will be formed when air passes through the aperture. Applicator means 46 comprises a member which spreads the fluid 98 delivered from conduit 45 from a drop or stream configuration into a sheet configuration by direct contact with the apertured end 63 as it is rotated past the applicator means 46. In one embodiment, the applicator means 46 may comprises a wiper 47 formed by a sheet of slightly flexible plastic or similar material, as shown in FIG. 3. Preferably, the applicator means comprises a brush 48 as shown in FIG. 4. The fluid 98 is deposited at or near the top center of the brush 48, from where is spreads laterally. The fluid 98 is transferred from the wiper 47 or brush 48 to the apertured end 63 of the wand 62 as the wand 62 rotates past the wiper 47 or brush 48. The applicator means 46 is positioned such that the apertured end 63 of the wand 63 contacts it as it rotates by. As the apertured end 63 passes from the applicator means 46, a film of fluid 98 is left on the wand 62. The wand 62 then rotates approximately 270 degrees into the exposed vertical position where the bubbles are formed by the force of wind or air currents passing through the apertured end 63. The now empty wand 62 then continues in its rotation to pass by the applicator means 46 for a new film of fluid 98 to be applied. The brush 48 is the preferred embodiment of the applicator means 46 because it produces a more even distribution of fluid 98 on the wand 62 with less excess fluid 98 to drip from the wand 62 during its continued rotation.

Figure 5:
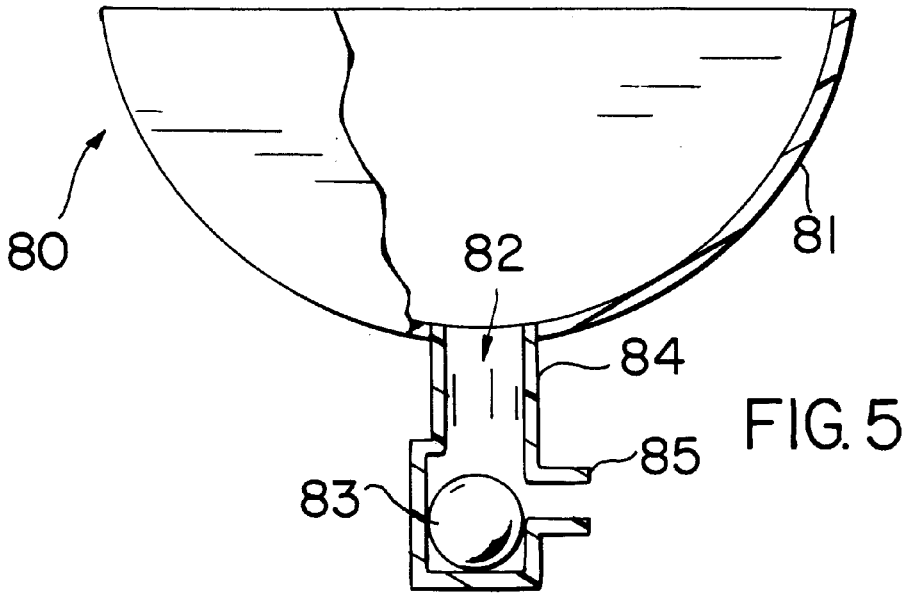
FIG. 5 is a partially exposed, cross-sectional view of the fluid recycling assembly.

Because there may be excess fluid 98 applied to the wand 62, the device further comprises a fluid recycling assembly 80, shown best in FIG. 5. The recycling assembly 80 mainly comprises a relatively large catch basin 81 having sloped walls which direct fluid 98 into a drain 82 at its lowermost point. A drain conduit 84 with an open lower end 85 connects the catch basin 81 to the receptacle body 11, such that any excess fluid 98 drains back into the receptacle 11 for re-application. Preferably, a drain one-way check valve 83 is positioned within conduit 84, such that fluid 98 can only flow into the receptacle 11 and not in the reverse direction. With this construction, the device is essentially spill-proof, since the majority of fluid is contained in the closed receptacle body 11 rather than in an open basin into which the wands 62 are dipped, and further in that the drain check valve 83 prevents reverse flow through the drain conduit 84 should the device be tipped over.

Figure 6:
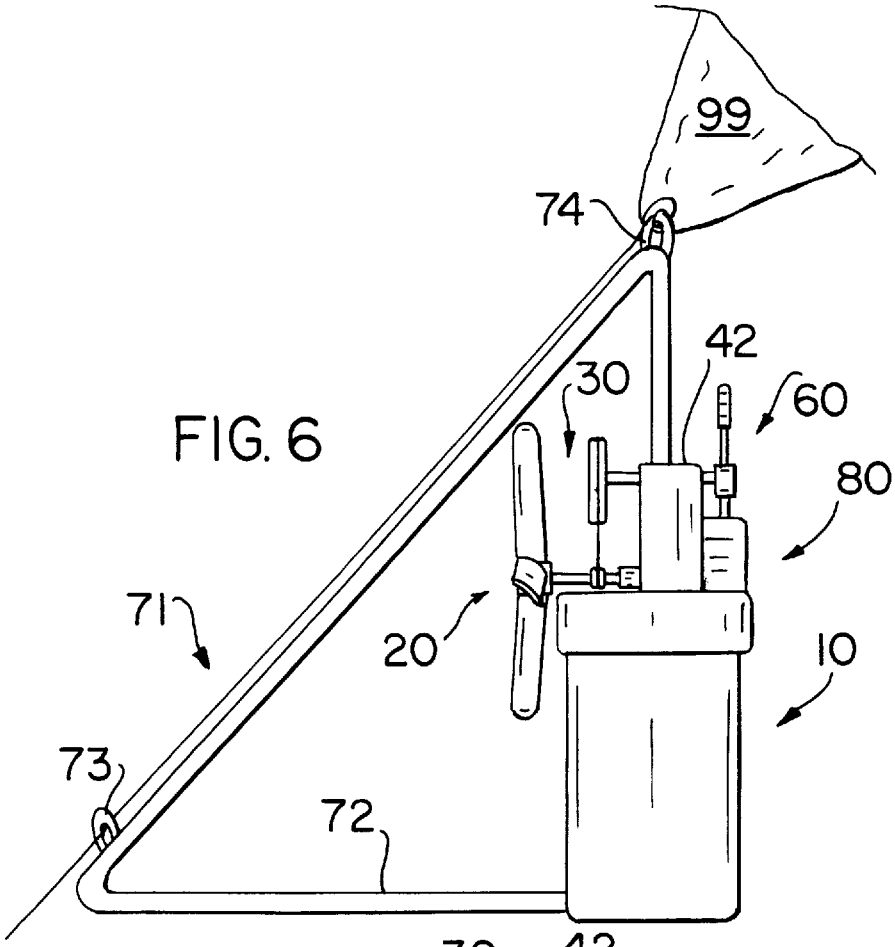
FIG. 6 shows the invention as attached to a kite.

The device as described is self-supporting and can be utilized on any horizontal surface or hand-held. The device may also be provided with mounting means for connecting the device to non-horizontal supports or to secure the device to horizontal supports, thus allowing the device to be attached to moving articles such as bicycles, automobiles, boats, etc. Because of the lightweight construction of the device, with no need for heavy batteries or motors to power the pumping or rotating mechanisms, the device can even be provided with a kite mounting assembly 71, as shown in FIG. 6. The kite mounting assembly 71 comprises a generally triangular frame 72 attached to the receptacle body 11 and cap member 12, with an angled portion having one or more line attachment members 73, such as an eyelet or ring, and/or one or more kite attaching members 74, such as a hook or clip, for securing the upper portion of the frame 72 to a kite 99. When the kite 99 is flown, the device will produce a steady stream of bubbles.

It is understood that certain equivalents and substitutions for elements and components set forth above may be obvious to those skilled in the art, and thus the true scope and definition of the invention is to be as set forth in the following claims.

I claim:

1. A wind-powered bubble making device comprising:

(A) a rotating wand assembly and a wind-powered fan assembly connected to means to transfer rotation from said fan assembly to said rotating wand assembly, such that rotation of said fan assembly causes the wand assembly to rotate, said wand assembly having a plurality of wands for forming bubbles;

(B) a generally closed fluid reservoir assembly containing bubble-making fluid;

(C) applicator means to apply said bubble-making fluid to said wands;

(D) pumping means to deliver said bubble-making fluid from said reservoir assembly to said applicator means, where said pumping means is powered by said fan assembly.

2. The device of claim 1, where said fan assembly comprises a fan axle and where said rotating wand assembly is mounted onto a secondary axle.

3. The device of claim 2, where said means to transfer rotation from said fan assembly to said rotating wand assembly comprises a pulley reduction assembly connecting said fan axle to said secondary axle.

4. The device of claim 2, where a cam is mounted onto said fan axle and where said pumping means comprises a spring-biased piston within a casing, and where said cam reciprocatingly moves said piston to deliver bubble-making fluid to said applicator means.

5. The device of claim 4, where said means to transfer rotation from said fan assembly to said rotating wand assembly comprises a pulley reduction assembly connecting said fan axle to said secondary axle.

6. The device of claim 1, where said wands each comprise an apertured end and said applicator means applies said bubble-making fluid directly to said apertured ends.

7. The device of claim 6, where said applicator means comprises a wiper.

8. The device of claim 6, where said applicator means comprises a brush.

9. The device of claim 1, further comprising fluid recycling means for returning any of said bubble-making fluid which falls from said wands to said fluid reservoir assembly.

10. The device of claim 9, where said fluid recycling means comprises a catch basin positioned beneath said wands, a drain in the bottom of said catch basin and a drain conduit connecting said drain to said fluid reservoir assembly.

11. The device of claim 10, where said fluid recycling means further comprises a check valve mounted within said drain conduit which prevents said bubble-making fluid from flowing from said fluid reservoir assembly to said catch basin.

12. The device of claim 1, where said fluid reservoir assembly comprises a removable receptacle body.

13. The device of claim 1, further comprising mounting means to connect said device to other objects.

14. The device of claim 13, where said mounting means comprises a line attachment member and a kite attachment member for connecting said device to a kite.

* * * * *